US011686470B2

(12) United States Patent
Albrecht et al.

(10) Patent No.: US 11,686,470 B2
(45) Date of Patent: Jun. 27, 2023

(54) NATURAL CIRCULATION MULTI-CIRCULATION PACKAGE BOILER FOR STEAM ASSISTED GRAVITY DRAINAGE (SAGD) PROCESS

(71) Applicant: The Babcock & Wilcox Company, Akron, OH (US)

(72) Inventors: Melvin J Albrecht, Homeworth, OH (US); Jason M Marshall, Wadsworth, OH (US); Jonathan B Ford, Amory, MS (US); Jeremy L Remus, Uniontown, OH (US)

(73) Assignee: The Babcock & Wilcox Company, Akron, OH (US)

( * ) Notice: Subject to any disclaimer, the term of this patent is extended or adjusted under 35 U.S.C. 154(b) by 671 days.

(21) Appl. No.: 16/779,750

(22) Filed: Feb. 3, 2020

(65) Prior Publication Data

US 2020/0256556 A1 Aug. 13, 2020

Related U.S. Application Data

(60) Provisional application No. 62/802,479, filed on Feb. 7, 2019.

(51) Int. Cl.

| | |
|---|---|
| ***F22B 15/00*** | (2006.01) |
| ***F22D 7/00*** | (2006.01) |
| ***F22G 7/00*** | (2006.01) |
| ***B01D 11/02*** | (2006.01) |
| ***F22D 11/00*** | (2006.01) |
| ***E21B 43/24*** | (2006.01) |

(52) U.S. Cl.

CPC ..... *F22D 11/006* (2013.01); *E21B 43/2406* (2013.01)

(58) Field of Classification Search

CPC ... F22B 21/002; F22D 11/006; E21B 43/2406
USPC ..... 122/235.12, 409, 463; 422/270; 101/366
See application file for complete search history.

(56) References Cited

U.S. PATENT DOCUMENTS 7,533,632 B2 * 5/2009 Stone ..... F22B 21/002 122/235.31

* cited by examiner

*Primary Examiner* — Monzer R Chorbaji
(74) *Attorney, Agent, or Firm* — Micheal J. Seymour

(57) ABSTRACT

A boiler includes a steam drum, an intermediate drum, and a lower drum. Each drum is divided into a clean section and a concentrated section. A channel that is fluidly connected to the clean section also runs down one side of the concentrated section in the intermediate drum and the lower drum. The presence of the channels permits low-quality feedwater tubes and high-quality feedwater tubes to be arranged in parallel rows next to each other.

20 Claims, 6 Drawing Sheets

NATURAL CIRCULATION MULTI-CIRCULATION PACKAGE BOILER FOR STEAM ASSISTED GRAVITY DRAINAGE (SAGD) PROCESS

RELATED APPLICATION DATA

This patent application claims priority to and is non-provisional of U.S. Provisional Patent Application No. 62/802,479 filed Feb. 7, 2019 and titled "NATURAL CIRCULATION MULTI-CIRCULATION PACKAGE BOILER FOR STEAM ASSISTED GRAVITY DRAINAGE (SAGD) PROCESS." The complete text of this patent application is hereby incorporated by reference as though fully set forth herein in its entirety.

BACKGROUND

The present disclosure relates generally to boiler design and, in particular, to boilers useful in Steam Assisted Gravity Drainage ("SAGD") processes for operating with sub-ASME quality feedwater such as oil sands, heavy oil and bitumen recovery.

The recovery of bitumen and subsequent processing into synthetic crude from the oil sands in northern Alberta, Canada continues to expand. Approximately 80% of known reserves are buried too deep to use conventional surface mining techniques. These deeper reserves are recovered using in-situ techniques such as SAGD in which steam is injected via horizontal wells into the oil sands deposit (injection well). This heats the bitumen, which flows by gravity to another other horizontal well lower in the deposit (production well), where the mixture of bitumen and water is taken to the surface. After the water is separated from the bitumen, the water is treated and then returned to the boiler for reheating and re-injection into the well.

Re-use of the water resource is a key factor for both conservation and environmental regulations. Even after treatment, however, the boiler feedwater can still contain volatile and non-volatile organic components as well as high levels of silica. Some systems and processes for addressing this issue include those in U.S. Pat. No. 7,533,632 and U.S. patent application Ser. No. 15/347,209. Other systems and processes for addressing this issue would be desirable.

BRIEF DESCRIPTION

The present disclosure relates to boilers and their use in steam assisted gravity drainage (SAGD) processes. The boilers include a steam drum, an intermediate drum, and a lower drum (or mud drum). Each of the three drums contains an internal divider that divides the drum into a clean section and a concentrated section (or dirty section). The intermediate drum and the lower drum also include a channel that runs adjacent a sidewall of the drum from the internal divider to a distal end of the concentrated section, with the channel being fluidly connected to the clean section of the drum. High-quality feedwater runs through the clean sections of the drums, while relatively low-quality feedwater runs through the concentrated sections of the drums. The presence of the channels in the concentrated section of the intermediate drum and the lower drum permit low-quality feedwater tubes and high-quality feedwater tubes to be arranged in parallel rows next to each other, as will be explained herein.

Disclosed in various embodiments are boilers comprising: an intermediate drum, a lower drum, a furnace, a clean section steam generating bank, and a concentrated section steam generating bank. The intermediate drum comprises (A) an internal divider that divides the intermediate drum into a clean section and a concentrated section, and (B) a channel that is fluidly connected to the clean section, the channel running adjacent a sidewall of the intermediate drum through the internal divider to a distal end of the concentrated section. The lower drum comprises (A) an internal divider that divides the intermediate drum into a clean section and a concentrated section, and (B) a channel that is fluidly connected to the clean section, the channel running adjacent a sidewall of the intermediate drum through the internal divider to a distal end of the concentrated section. The furnace is defined by a furnace sidewall and a baffle wall. Tubes in a front portion of the furnace sidewall and a front portion of the baffle wall extend between the intermediate drum channel and the lower drum channel. The clean section steam generating bank extends between the intermediate drum clean section and the lower drum clean section. Finally, the concentrated section steam generating bank extends between the intermediate drum concentrated section and the lower drum concentrated section.

In a gas flowpath, the clean section steam generating bank may be downstream of the furnace and upstream of the concentrated section steam generating bank.

The clean section steam generating bank and the concentrated section steam generating bank may be located on an opposite side of the baffle wall from the furnace.

The concentrated section steam generating bank may be located so that heat flux on the concentrated section steam generating bank is less than 20,000 BTU/hr-ft$^2$ or 10,000 BTU/hr-ft$^2$, or at an acceptable rate, which may depend upon the application and/or water conditions.

The furnace, the clean section steam generating bank, and the concentrated section steam generating bank may operate by natural circulation, and do not contain mechanical pumps.

The ratio of a cross-sectional area of the intermediate drum channel to a cross-sectional area of the intermediate drum (inner diameter) may be from about 0.1 to about 0.2. The ratio of a cross-sectional area of the lower drum channel to a cross-sectional area of the lower drum (inner diameter) may be from about 0.1 to about 0.2.

The boiler may further comprise a steam drum comprising an internal divider that divides the steam drum into a clean section and a concentrated section, the internal divider including a veer that fluidly connects the clean section and the concentrated section. In some embodiments, at least one clean section riser extends between the intermediate drum clean section and the steam drum clean section; and at least one concentrated section riser extends between the intermediate drum concentrated section and the steam drum concentrated section. In additional embodiments, at least one clean section downcomer extends between the steam drum clean section and the lower drum clean section; and at least one concentrated section downcomer extends between the steam drum concentrated section and the lower drum concentrated section. The steam drum may be located above the intermediate drum, and the intermediate drum is located above the lower drum. The steam drum may comprise a scrubber and a perforated plate.

The boiler may further comprise a rear wall extending between the furnace sidewall and a boiler sidewall. The boiler may further comprise an economizer downstream of the concentrated section steam generating bank in the gas flowpath. The boiler may further comprise burners located at a front end of the boiler, and adapted to provide a heated gas to the furnace. Multi-lead ribbed (MLR) tubing may be used in the furnace sidewall, the rear wall, the boiler sidewall, the steam generating bank, and/or the baffle wall, or in any combination thereof.

Also disclosed are methods for using a boiler, comprising: receiving a boiler as described above; and using steam generated by the boiler. The feedwater to the boiler may be fed to the clean section of the steam drum.

These and other non-limiting aspects of the present disclosure are discussed further herein.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
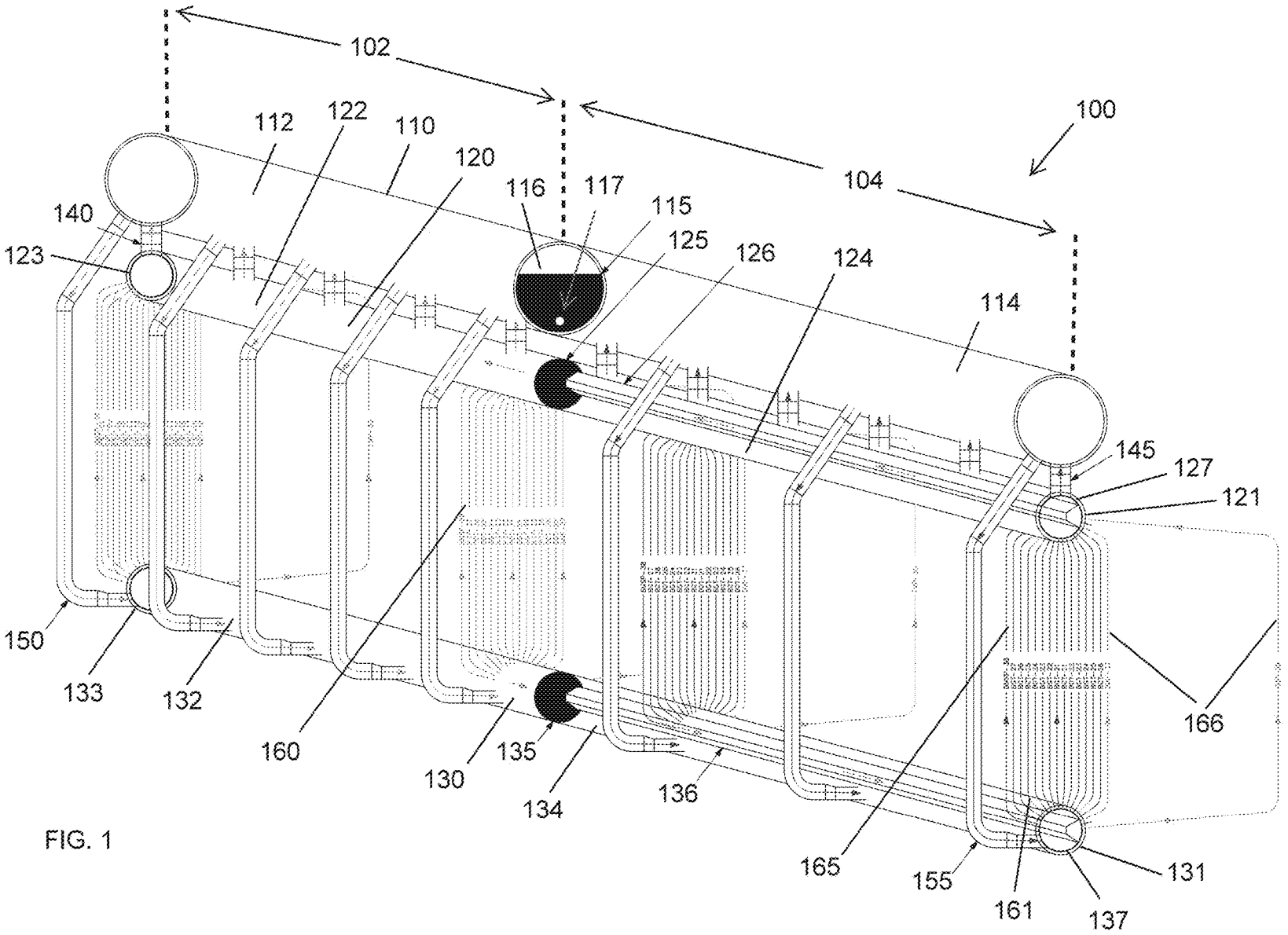
FIG. 1 is a first side perspective schematic diagram illustrating relevant parts of a boiler in accordance with some embodiments of the present disclosure.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

The term "comprising" is used herein as requiring the presence of the named components/steps and allowing the presence of other components/steps. The term "comprising" should be construed to include the term "consisting of", which allows the presence of only the named components/steps.

Numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

Some terms used herein are relative terms. For example, the terms "upper" and "lower" are relative to each other in location, i.e. an upper component is located at a higher elevation than a lower component. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the fluids flow through an upstream component prior to flowing through a downstream component. It should be noted that in a loop, a first component can be described as being both upstream of and downstream of a second component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" or "roof" and "bottom" or "floor" or "base" are used to refer to locations/surfaces where the top/roof is always higher than the bottom/floor/base relative to an absolute reference, i.e. the surface of the earth. The terms "upwards" and "downwards" are also relative to an absolute reference; upwards is always against the gravity of the earth.

As used herein, the front and rear are located along an x-axis; the left and right sides are located along a y-axis; and the roof and floor are located along a z-axis, wherein the three axes are perpendicular to each other.

A fluid at a temperature that is above its saturation temperature at a given pressure is considered to be "superheated." A superheated fluid can be cooled (i.e. transfer energy) without changing its phase. As used herein, the term "wet steam" refers to a saturated steam/water mixture.

Water may be referred to herein as "high-quality" or "low-quality". These two terms are relative to each other, and not to ASME standards. High-quality water has a lower concentration of dissolved contaminants compared to low-quality water.

To the extent that explanations of certain terminology or principles of the boiler and/or steam generator arts may be necessary to understand the present disclosure, the reader is referred to *Steam/its generation and use,* 42nd Edition, edited by G. L. Tomei, Copyright 2015, The Babcock & Wilcox Company, ISBN 978-0-9634570-2-8, the text of which is hereby incorporated by reference as though fully set forth herein.

As is known to those skilled in the art, heat transfer surfaces which convey steam-water mixtures are commonly referred to as evaporative boiler surfaces; and heat transfer surfaces which convey steam therethrough are commonly referred to as superheating (or reheating, depending upon the associated steam turbine configuration) surfaces. Regardless of the type of heating surface, the sizes of the tubes, their material, diameter, wall thickness, number, and arrangement are based upon temperature and pressure for service, according to applicable boiler design codes, such as the American Society of Mechanical Engineers (ASME) Boiler and Pressure Vessel Code, Section I, or other equivalent codes as required by law. ASME also identifies different standards of water quality based on the amount of various dissolved compounds and total dissolved solids (TDS) in the water.

As noted above, feedwater quality and boiler water quality are concerns, as the evaporation of steam results in contaminants in the boiler water becoming more concentrated. The concentrated contaminants can leave deposits in the various water pathways through the boiler, negatively impacting performance and degrading components. As a result of this concentration, the feedwater generally should be cleaner (i.e. lower permissible TDS) than the boiler water, so that boiler water quality limits can be maintained. In SAGD and similar process operations, the recovered water, after filtration, still contains relatively substantial amounts of contaminants.

In the present disclosure, the boiler includes multi-circulation technology for use in SAGD applications or other applications where feedwater contains relatively substantial amounts of contaminants. The feedwater is separated into two separate circulation loops within the boiler, referred to herein as (1) a "clean" section and (2) a "concentrated" or "dirty" section. Boiler water with the lowest concentration of dissolved solids circulates in the high heat flux zones of the boiler in the clean section. Boiler water with the highest concentration of dissolved solids circulates in the low heat flux zone of the boiler in the concentrated section. Deposition of contaminants in the low heat flux zone is less problematic due to the lower operating temperatures. The multi-circulation boiler design may be particularly useful for processes utilizing produced water (from the oil recovery stream) as a source of boiler feedwater.

Very generally, in the boiler, a heated gas flowpath runs past water flowing along a water flowpath (i.e. the clean and concentrated sections). The water in the water flowpath captures heat energy from the gas flowpath and forms a water/steam mixture, which is conveyed to a steam separator. The steam separator separates steam from water, and conveys the steam to an outlet for use for desired purposes.

FIG. 1 schematically illustrates a portion of a boiler 100 in accordance with some embodiments of the present disclosure. The boiler can operate by natural circulation, and does not need mechanical pumps to cause fluid flow. It is noted that this diagram does not show various tubes that would be present throughout much of the boiler for connecting the various components for natural circulation (i.e., without the need for mechanical circulation pumps) of feedwater, steam, and a water/steam mixture.

The boiler includes three drums: a steam drum 110, an intermediate drum 120, and a lower drum 130. The steam drum 110 is located above both the intermediate drum 120 and the lower drum 130. The intermediate drum 120 is located at a height below the steam drum 110 and above the lower drum 130. The lower drum 130 is located below both the steam drum 110 and the intermediate drum 120. In some embodiments, the centers of the drums are vertically aligned with each other.

In the steam drum 110, an internal divider 115 normal to the axis of the drum divides the interior volume of the steam drum into a clean section 112 and a concentrated section 114. It is noted that the clean section and the concentrated section do not have to take up the same volume or length of the steam drum. Solid portions of the internal divider 115 are illustrated in black. As can be seen here, the internal divider 115 is in the form of a veer that fluidly connects the clean section and the concentrated section. The veer is illustrated in the shape of a circle with a chord 116 at the top, and a circular segment removed along the top. This removed segment forms a top opening through which steam can travel between the clean section and the concentrated sections. A bottom opening 117 is also present along the bottom of the veer as well, through which heated water from the clean section can function as feedwater to the concentrated section. The bottom opening should be located below the water level in the steam drum, and can be in the form of an appropriately sized pipe. A natural head differential is present between the clean side and the concentrated side, so that water only flows from the clean side to the concentrated side.

The steam drum also includes one or more primary separators (not shown) which separate steam from water. The primary separator can be, for example, a perforated plate, or can operate by centrifugal force or radial acceleration to separate steam from water. One or more secondary scrubbers (not shown) can be used to increase steam separation, by providing a large surface that intercepts water droplets as steam flows sinuously between closely fitted plates. A resistor plate or perforated plate (not shown) may be located after the scrubbers to further separate water from steam. The resistor plate contains many small holes.

In the intermediate drum 120, an internal divider 125 normal to the axis of the drum divides the interior volume of the intermediate drum into a clean section 122 and a concentrated section 124. The clean section has a distal end 123, and the concentrated section has a distal end 127 (relative to the internal divider). It is noted that the clean section and the concentrated section do not have to take up the same volume or length of the intermediate drum. Solid portions of the internal divider 125 are illustrated in black. As shown here, the internal divider 125 is completely solid, except for an opening along its outer perimeter adjacent the sidewall 121 of the intermediate drum.

A channel 126 is also present in the intermediate drum, which runs from the opening of the internal divider to the distal end 127 of the concentrated section. The channel 126 is fluidly connected to the clean section, and is located adjacent the sidewall 121 of the intermediate drum. The channel is illustrated here as being formed from three solid walls, which separate the internal volume of the channel from the concentrated section. The channel can have a rectangular shape, or a trapezoidal shape, or could be cylindrical. In some embodiments, the channel 126 can occupy from about 30 degrees to about 90 degrees of the perimeter of the sidewall 121, or from about 30 degrees to about 60 degrees. In some embodiments, the ratio of the cross-sectional area of the channel to the cross-sectional area of the intermediate drum (inner diameter) is from about 0.1 to about 0.3, or in other words, the channel takes up about 10% to about 30% of the cross-sectional area of the intermediate drum. In some narrower embodiments, the ratio is from about 0.1 to about 0.2. The clean section 122 and the concentrated section 124 are completely separated from each other, so there is no mixing of fluids between the clean section 122 and the concentrated section 124 of the intermediate drum.

In the lower drum 130, an internal divider 135 normal to the axis of the drum divides the interior volume of the lower drum into a clean section 132 and a concentrated section 134. The clean section has a distal end 133, and the concentrated section has a distal end 137 (relative to the internal divider). It is noted that the clean section and the concentrated section do not have to take up the same volume or length of the lower drum. Solid portions of the internal divider 135 are illustrated in black. As shown here, the internal divider 135 is completely solid, except for an opening along its outer perimeter adjacent the sidewall 131 of the lower drum.

A channel 136 is also present in the lower drum, which runs from the opening of the internal divider to the distal end 137 of the concentrated section. The channel 136 is fluidly connected to the clean section, and is located adjacent the sidewall 131 of the lower drum. The channel is illustrated here as being formed from three solid walls, which separate the internal volume of the channel from the concentrated section. The channel can have a rectangular shape, or a trapezoidal shape, or could be cylindrical. In some embodiments, the channel 136 can occupy from about 30 degrees to about 90 degrees of the perimeter of the sidewall 131, or from about 30 degrees to about 60 degrees. In some embodiments, the ratio of the cross-sectional area of the channel to the cross-sectional area of the lower drum (inner diameter) is from about 0.1 to about 0.3, or in other words, the channel takes up about 10% to about 30% of the cross-sectional area of the lower drum. In some narrower embodiments, the ratio is from about 0.1 to about 0.2. The clean section 132 and the concentrated section 134 are completely separated from each other, so there is no mixing of fluids between the clean section 132 and the concentrated section 134 of the lower drum.

It should be noted that the steam drum 110, the intermediate drum 120, and the lower drum 130 are oriented so their clean sections 112, 122, 132 and their concentrated sections 114, 124, 134 are vertically aligned with each other. This orientation permits tubes to extend vertically between the three drums while maintaining separate circulation circuits. Also, the intermediate drum 120 and the lower drum 130 are oriented so their channels 126, 136 are on the same side of the boiler. This orientation permits tubes to extend between the two channels.

As further seen in FIG. 1, a plurality of clean risers 140 connect the clean section 122 of the intermediate drum 120 to the clean section 112 of the steam drum 110. A plurality of concentrated risers 145 connect the concentrated section 124 of the intermediate drum 120 to the concentrated section 114 of the steam drum 110. A plurality of clean downcomers 150 run between the clean section 112 of the steam drum 110 and the clean section 132 of the lower drum 130. A plurality of concentrated downcomers 155 run between the concentrated section 114 of the steam drum 110 and the concentrated section 134 of the lower drum 130.

At least one clean section steam generating bank 160 extends between the clean section 122 of the intermediate drum 120 and the clean section 132 of the lower drum 130. At least one concentrated section steam generating bank 165 extends between the concentrated section 124 of the intermediate drum 120 and the concentrated section 134 of the lower drum 130. Each steam generating bank (clean or concentrated) is made up of several rows and columns of tubes which are arranged with spaces between tubes so that heated gas can flow through the tubes and transfer heat energy into water flowing through the tubes. No membrane is present between tubes in the steam generating bank(s).

The boiler 110 may thus be considered to be divided into a clean section 102 and a concentrated or dirty section 104. Relatively high-quality water flows through the clean section, and relatively low-quality water flows through the concentrated section. (Please note that "low" and "high" quality water are relative to each other, and not to ASME standards.) The clean section 102 of the boiler includes the clean section 112 of the steam drum 110; the clean section 122 of the intermediate drum 120; the clean section 132 of the lower drum 130; the clean risers 140; the clean downcomers 150; and the clean section steam generating bank(s) 160. The concentrated section 104 of the boiler includes the concentrated section 114 of the steam drum 110; the concentrated section 124 of the intermediate drum 120; the concentrated section 134 of the lower drum 130; the concentrated risers 145; the concentrated downcomers 155; and the concentrated section steam generating bank(s) 165. The clean section 102 and the concentrated section 104 are fluidly connected only through the steam drum 110, where the bottom opening 117 permits water to be fed from the steam drum clean section 112 into the steam drum concentrated section 114.

The clean and concentrated section steam generating banks 160, 165 are formed from a series of tubes extending between the intermediate drum 120 and the lower drum 130. It is noted that due to the presence of the channels 126, 136 along one side of these drums, it is possible for tubes in the concentrated section (i.e. with dirty water flowing through them) to be placed next to tubes in the clean section (i.e. with clean water flowing through them) in the lateral direction. Referring still to FIG. 1, tubes 161 are fluidly connected to the concentrated sections 124, 134 of the intermediate and lower drums 120, 130. Tubes 166 are fluidly connected to the channels 126, 136 of the intermediate and lower drums 120, 130. These tubes 161, 166 are in a common plane (going left-to-right across the page), but receive water of different quality. This permits flexible boiler design and exposure to different heat fluxes, as will be explained further herein.

FIG. 1 also illustrates the water flowpath through the boiler. Feedwater enters the clean section 112 of the steam drum 110. The water from the clean section 112 flows through clean downcomers 150 down to the clean section 132 of the lower drum 130. The water from the concentrated section 114 flows through concentrated downcomers 155 down to the concentrated section 134 of the lower drum 130. Water from the clean section 112 can also flow into the concentrated section 114 of the steam drum through opening 117, acting as feedwater for the concentrated section 104 of the boiler. The clean section 132 feeds the clean section steam generating bank(s) 160, and the concentrated section 134 feeds the concentrated section steam generating bank(s) 165. In the tubes of these steam generating banks, water absorbs heat energy from the heated (flue) gas and becomes a steam/water mixture. The steam/water mixture flows upwards into the clean section 122 and the concentrated section 124 of the intermediate drum 120. The steam/water mixture passes through clean risers 140 and concentrated risers 145 from the intermediate drum 120 into the clean section 112 and the concentrated section 114 of the steam drum 110. In the steam drum, the mixture is separated into water and wet steam (i.e., saturated steam).

Figure 2:
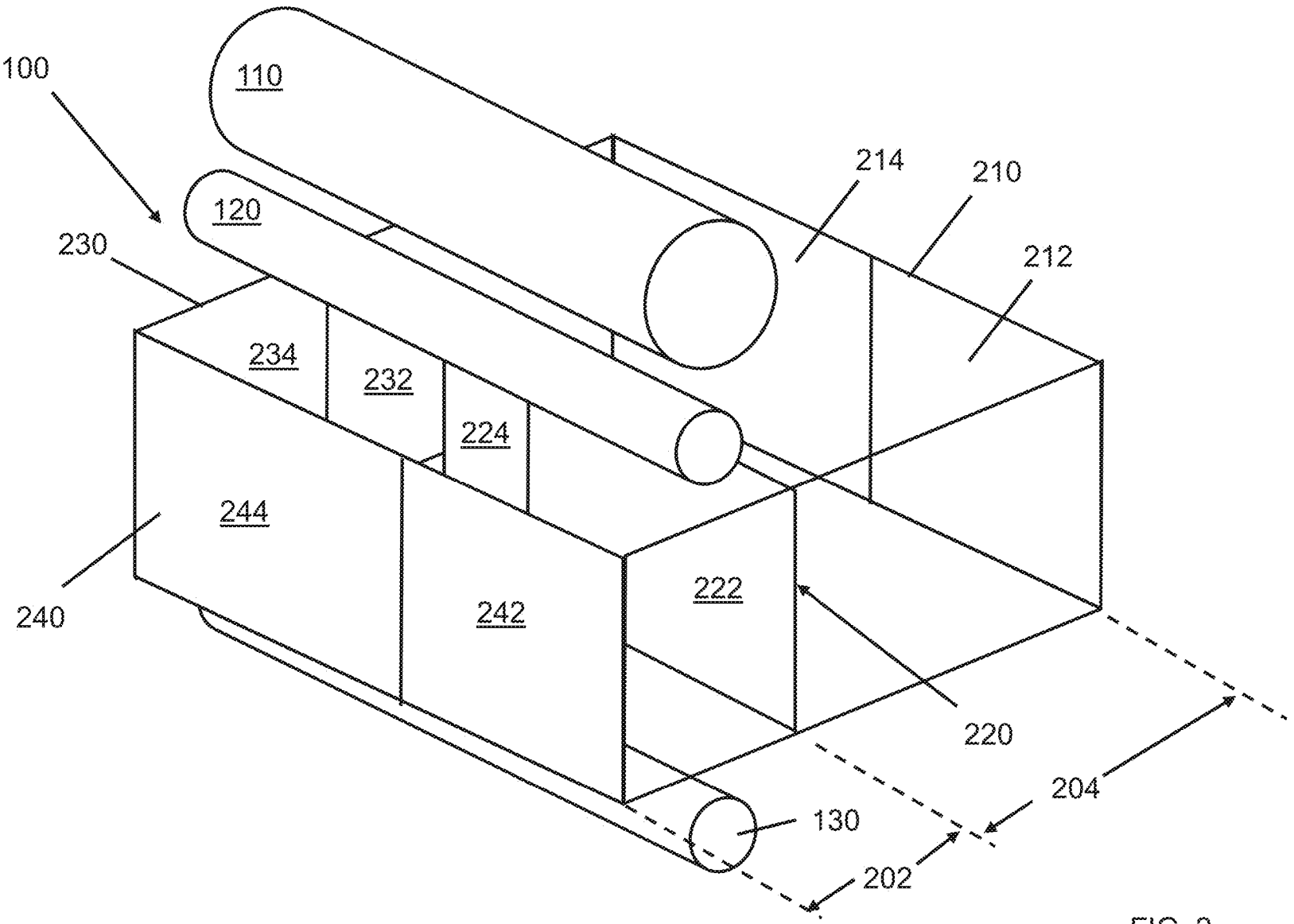
FIG. 2 is a second side perspective schematic diagram illustrating the various walls of the boiler of FIG. 1. For clarity, the individual tubes, downcomers, and risers are not shown in this diagram.

FIG. 2 is a perspective view of the boiler 100, identifying various walls of the boiler and their relationship to each other. For clarity, the tubes of the steam generating banks, and the tubes that make up the roof and floor of the boiler are not shown.

The boiler 100 has several walls. The walls are formed from the tubes that run between the intermediate drum 120 and the lower drum 130. A membrane (not illustrated) is present between adjacent tubes in the walls (note, not all tubes are part of the walls). The membrane significantly reduces the ability of gas to flow from one side of the tube to the other side, forming membrane tube panels that act as a wall and can direct the gas flow, i.e. each membrane tube panel is gas-tight. As is known in the art, water will run through the interior of the tubes and absorb heat energy from heated gas passing along the exterior of the tubes.

The boiler 100 is divided into a boiler section 202 and a furnace section 204. The furnace section may be from about 60% to about 65% of the width of the boiler. The walls of the boiler 100 include a furnace sidewall 210 and a baffle wall 220, which are parallel to each other. The furnace sidewall 210 is divided into a front portion 212 and a rear portion 214. The baffle wall 220 is also divided into a front portion 222 and a rear portion 224. The boiler also includes a boiler sidewall 240, which is also parallel to the furnace sidewall and the baffle wall. The boiler wall 240 is also divided into a front portion 242 and a rear portion 244. It is noted that the front portions 212, 222, 242 of these three walls are aligned with each other.

The boiler also includes a rear wall 230, which can be divided into a furnace rear wall 232 and a boiler rear wall 234. The rear wall 230 extends between the furnace sidewall 210 and the boiler sidewall 240, or in other words is perpendicular to these sidewalls and the baffle wall as well. The furnace rear wall 232 meets the furnace sidewall 210 at one rear corner, and the boiler rear wall 234 meets the boiler sidewall 240 at the other rear corner. The baffle wall 220 does not extend to the rear wall 230.

The boiler section 202 of the boiler is located between the boiler sidewall 240 and the baffle wall 220. The furnace section 204 of the boiler is located between the baffle wall 220 and the furnace sidewall 210. The interior of the furnace section is hollow. Put another way, there are no water tubes or tube panels extending between the baffle wall and the furnace sidewall within the furnace section. The clean section and concentrated steam generating banks (not shown) are present in the boiler section, or in other words are located on the opposite side of the baffle wall from the furnace. The steam drum 110, intermediate drum 120, and lower drum 130 are located above the boiler section 202.

Considering both FIG. 1 and FIG. 2 together now, all of the tubes of the furnace sidewall 210 and all of the tubes of the baffle wall 220 are fed with water from the clean section of the boiler. In particular, the tubes that make up the front portion 212 of the furnace sidewall and the tubes that make up the front portion 222 of the baffle wall are connected to the channels 126, 136 of the intermediate drum 120 and the lower drum 130. Put another way, tubes 166 of FIG. 1 form the front portion 212 of the furnace sidewall and the front portion 222 of the baffle wall in FIG. 2. The tubes that make up the front portion 242 of the boiler sidewall are connected to the concentrated sections 124, 134 of the intermediate drum and the lower drum.

The tubes that make up the rear portions 214, 224, 244 of the furnace sidewall, baffle wall, and boiler sidewall are connected to the clean sections 122, 132 of the intermediate drum and the lower drum (i.e. they are not connected to the channels 126, 136). The tubes that make up the furnace rear wall 232 and the boiler rear wall 234 may also be connected to the clean sections 122, 132 of the intermediate drum and the lower drum (i.e. they are not connected to the channels 126, 136).

Although the roof and floor of the boiler are not shown, an integrated configuration is used such that the floor, walls, and roof of the boiler are a single water circuit. This reduces the circuit length to reduce chances of internal deposits.

The preferred sloping of the roof and floor with respect to their respective drum is about 2 to 30 degrees to the horizontal, or more preferably about 2 to 5 degrees. The lower drum can be provided with access to one or more drains, for draining and cleaning of the water circuit. The exterior of the membrane walls is desirably covered with insulation, e.g. about 3 to 6 inches minimum fiber board.

Minimum saturated velocities ensure that steam/water stratification, steam blanketing, and departure from nucleate boiling (DNB) do not occur, and that the possibility of solids deposition is minimized. Both steam blanketing and solids deposition can cause tube failure. Limits on saturated velocity are a function of tube orientation, tube location, internal tube surface geometry, heat flux, and fluid state.

Due to the shallow sloping tube geometry of several locations in the boiler the minimum saturated velocity requirements to avoid stratification are greater than the predicted velocities in these locations. As a result, when minimum saturated velocity requirements are not met, multi-lead ribbed (MLR) tubing should be used for the tubes in the furnace sidewall 210, the rear wall 230, the boiler sidewall 240, the baffle wall 220, some or all areas of the clean steam generating bank(s) 160, and/or some or all areas of the concentrated steam generating bank(s) 165. It is noted that the MLR tubing is commonly used in the floor and roof portions of the water circuit including these walls and banks.

Figure 3:
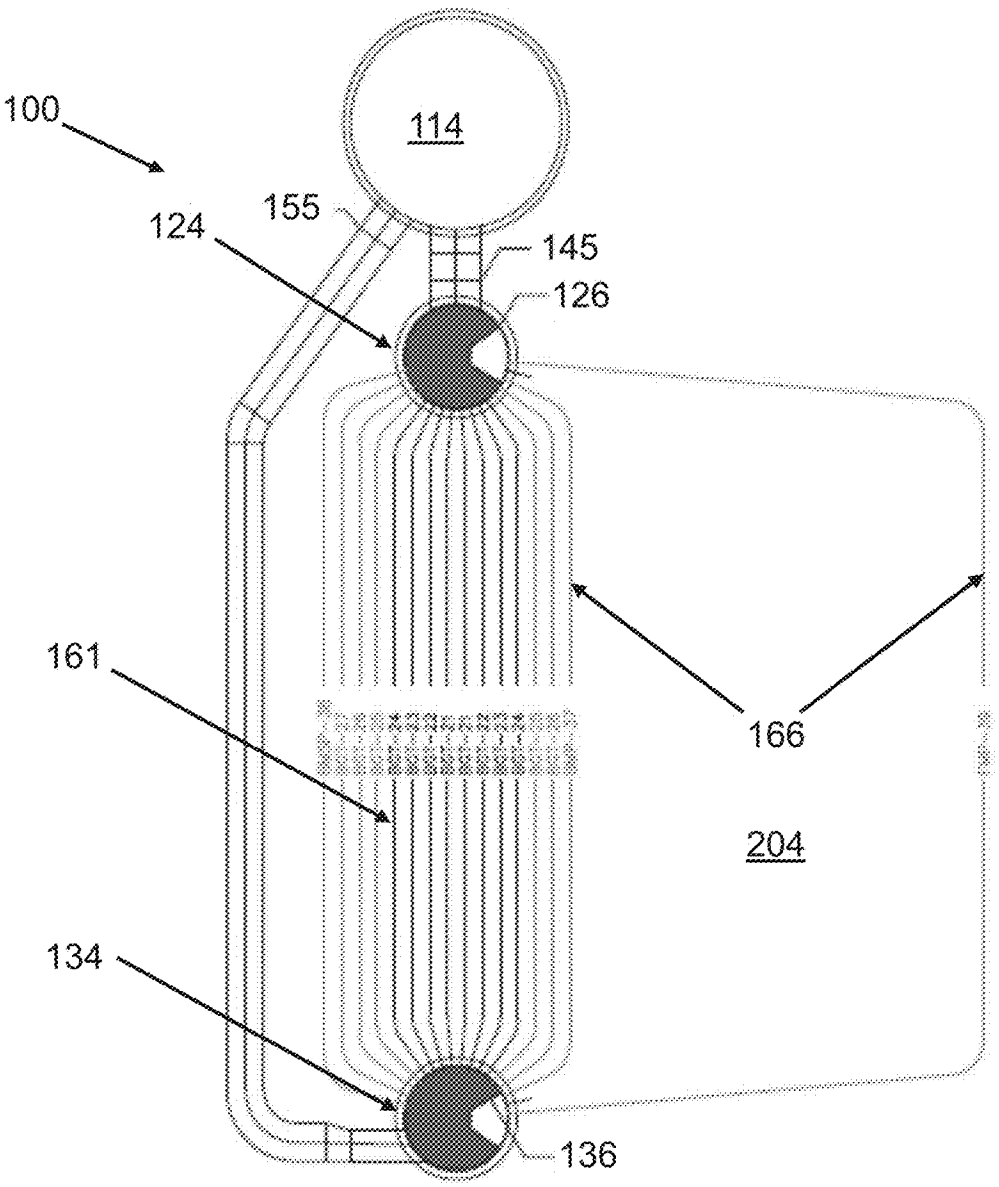
FIG. 3 is a front cross-sectional view of the steam generating bank along the concentrated sections of the steam drum, the intermediate drum, and the lower drum.

FIG. 3 is a front cross-sectional view of a steam generating bank along the concentrated sections 114, 124, 134 of the steam drum, the intermediate drum, and the lower drum. In this view, concentrated riser 145 and concentrated downcomer 155 are visible. The dark sections in the intermediate drum and the lower drum indicate the concentrated sections 124, 134, while the white section indicates the channels 126, 136 that are fluidly connected to the clean section. Tubes 161 are fluidly connected to the concentrated sections 124, 134. Referring back to FIG. 2, these tubes 161 will form the front portion 242 of the boiler sidewall. Tubes 166, which are connected to the channels 126, 136, will form the front portions 212, 222 of the furnace sidewall and the baffle wall. These front portions 212, 222, 242 are aligned with each other across the width of the boiler. Returning now to FIG. 3, the furnace section 204 is indicated between tubes 166.

Figure 4:
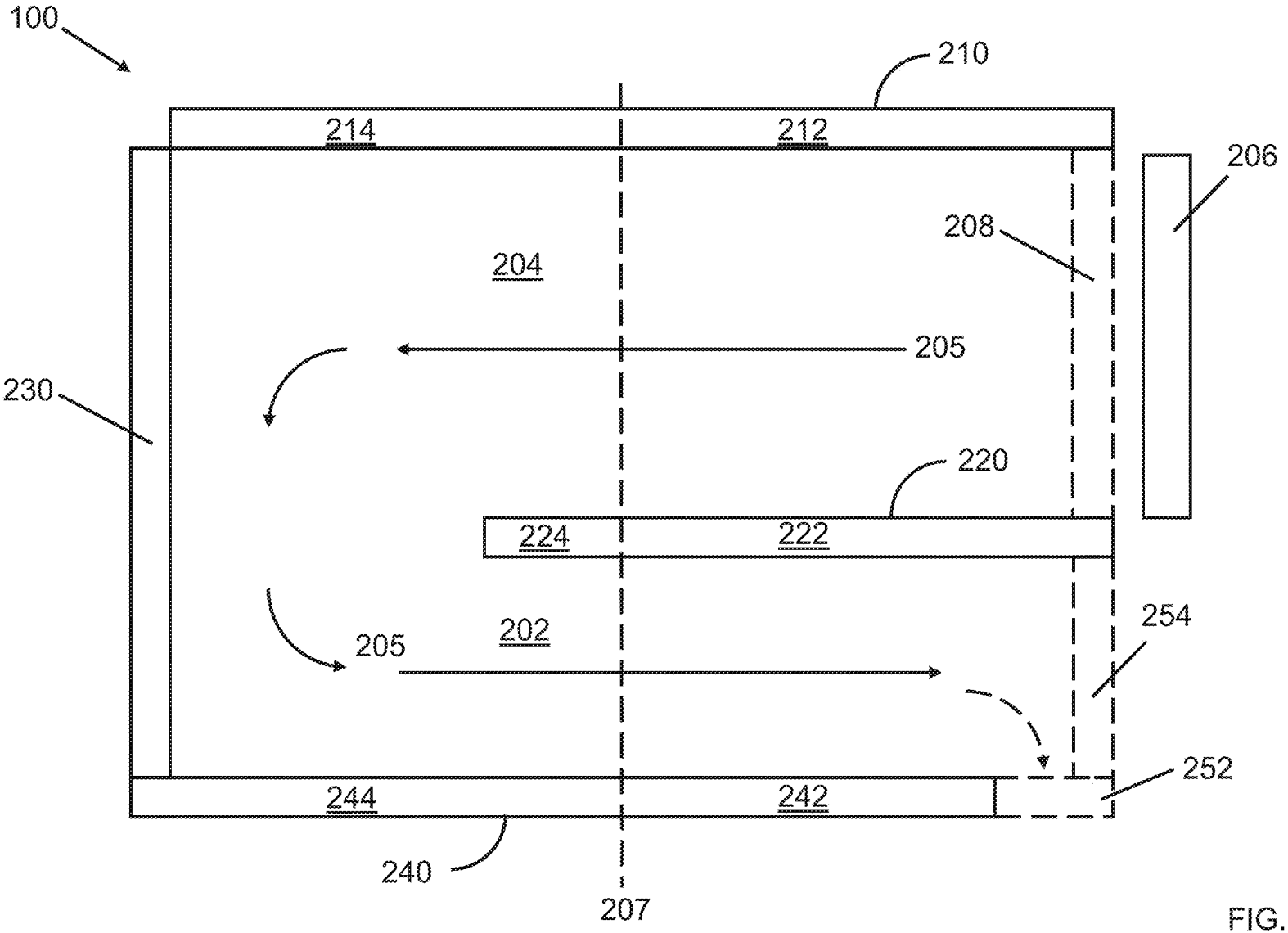
FIG. 4 is a plan view schematic diagram of the boiler of FIG. 1. For clarity, the individual tubes of the various walls and the steam generating banks are not shown in this diagram.

FIG. 4 is a plan view schematic diagram of the boiler 100, indicating the heated gas flowpath and providing detail on some additional structures. The furnace sidewall 210, baffle wall 220, boiler sidewall 240, and rear wall 230 are all indicated here. Arrows 205 indicate the flowpath of the heated gas which transfers heat energy to the water in the tubes of the various walls and the steam generating banks. The heated gas can be flue gas, or can be generated by front wall burners 206. The heated gas first travels through the furnace 204. The walls of the furnace are fed by the clean section, and contain high-quality feedwater (i.e. lower concentration of contaminants) that is exposed to high heat fluxes. At the rear wall 230, the heated gases turn 180° and then travel through the tubes in the boiler section 202.

The heated gases will first pass through the clean section steam generating bank(s), then pass through the concentrated section steam generating bank(s). The dashed line 207 indicates where the internal dividers 125, 135 would be located. The rear portions 214, 224, 244 of the boiler walls 210, 220, 240 to the left of the dashed line 207 are formed by tubes connected directly to the clean sections of the intermediate drum and the lower drum. The front portions 212, 222 of the boiler walls to the right of the dashed line 207 are formed by tubes connected to the channels 126, 136 that are fed with high-quality water. Put another way, the furnace sidewall 210, the baffle wall 220, and the rear wall 230 are fed entirely with high-quality water from the clean section. The front portion 242 of the boiler sidewall 240 is formed by tubes connected directly to the concentrated sections of the intermediate drum and the lower drum. The concentrated section steam generating bank(s) is located so that heat flux on the concentrated section steam generating bank is reduced to an acceptable rate. Depending on the boiler design, this location may change.

As the heated gas returns to the front of the boiler, the heated gas passes through an outlet screen, which is essentially a wall of tubes without membrane between the tubes, and exits the boiler. Reference numerals 252, 254 indicate portions of a wall which could be the outlet screen. For example, wall portion 252 may be the outlet screen, and wall portion 254 may be a membrane tube panel that acts as a boiler section frontwall. The heated gas can subsequently pass through an economizer to extract remaining heat energy and provide heated feedwater to the boiler. After passing through the economizer, the heated gas can also be sent to an air preheater and recycled as combustion air for the boiler.

In some applications, the boiler includes a burner wall 208 located in front of the burners 206, the burner wall being formed from membraned water-cooled tubes and having burner openings therein. In these applications, clean water flows through the water-cooled tubes that form burner wall 208. Due to location, the tubes of burner wall 208 would be fluidly connected to the channels 126, 136 of the intermediate drum 120 and the lower drum 130. These tubes in the burner wall can also be MLR tubing.

Figure 5:
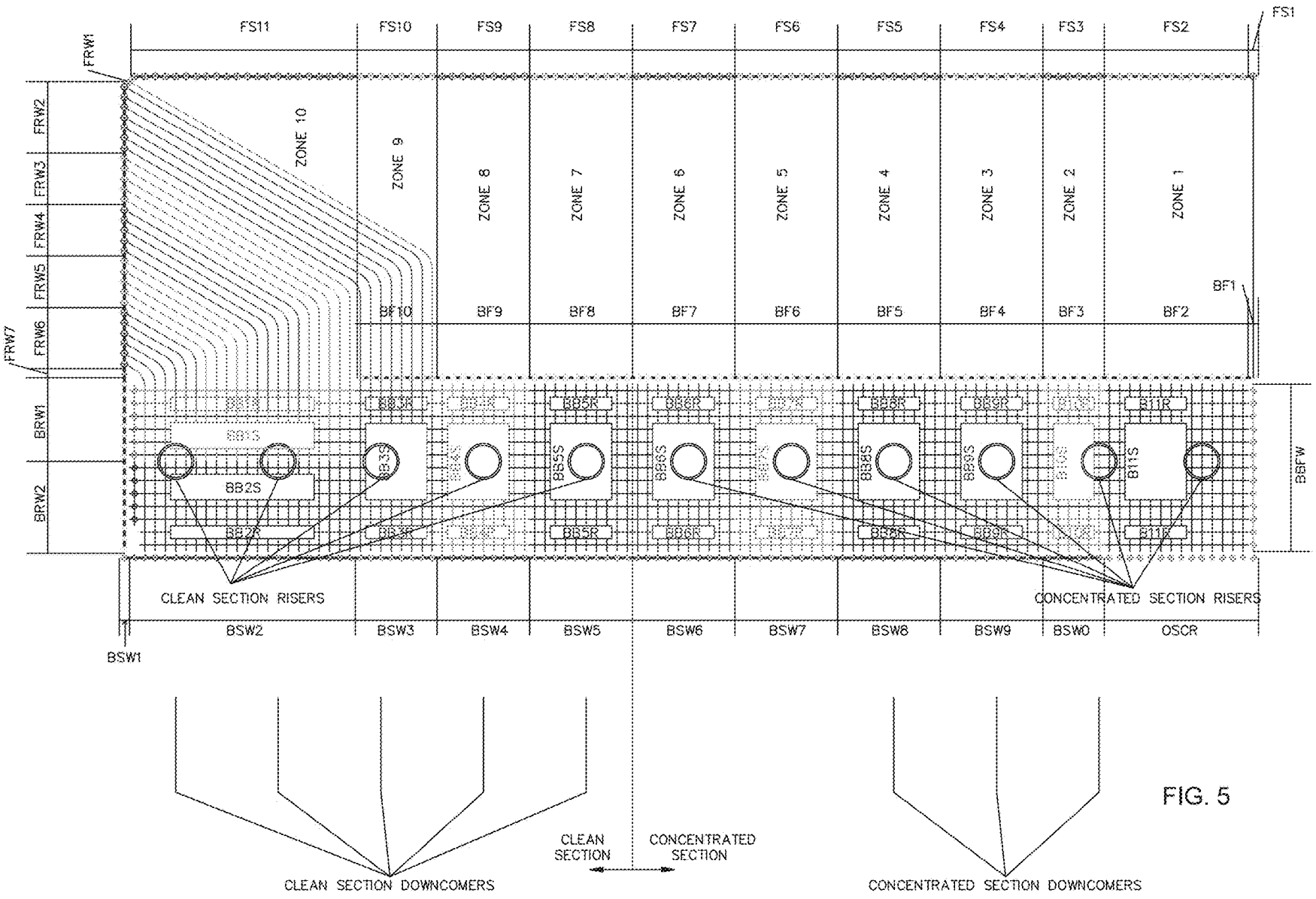
FIG. 5 is a plan view schematic diagram of the boiler of FIG. 1, illustrating the various circuits through which water/steam can pass through the boiler.
Figure 6:
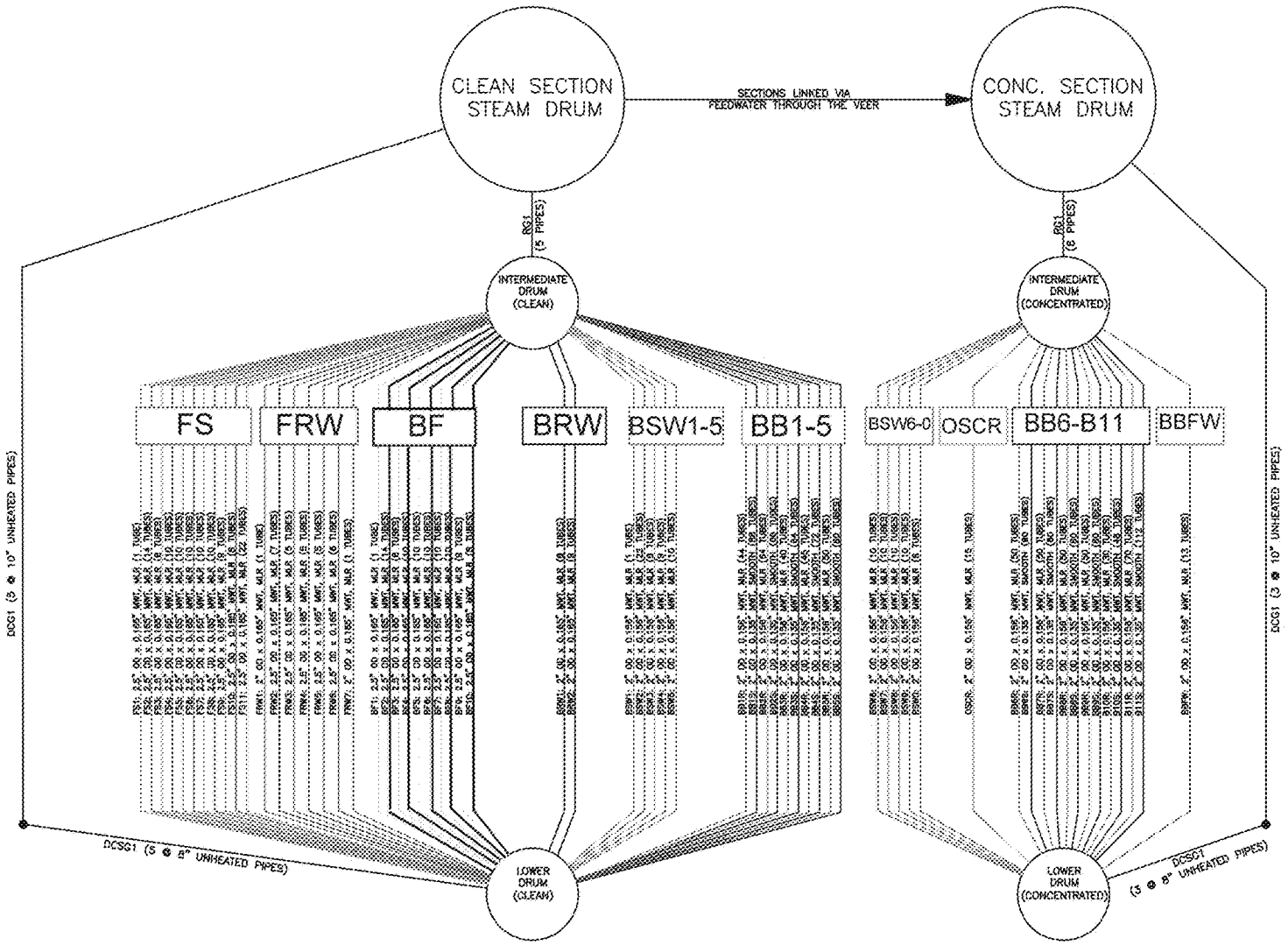
FIG. 6 is a schematic diagram of the boiler of FIG. 1, illustrating the various circuits through which water/steam can pass through the boiler.

FIG. 5 and FIG. 6 are circuit diagrams that provide more detail on how water/steam pass through the various walls and drums. FIG. 5 is a plan view of the boiler. FIG. 6 shows the connections between the walls and the three drums.

In FIG. 5, the abbreviation FS refers to the furnace sidewall. There are 11 zones in this wall, labeled FS1-FS11. The abbreviation BF refers to the baffle wall. There are 10 zones in this wall, labeled BF1-BF10. The abbreviation FRW refers to the furnace rear wall. There are 7 zones in this wall, labeled FRW1-FRW7. The abbreviation BRW refers to the boiler rear wall. There are 2 zones in this wall, labeled BRW1 and BRW2. The abbreviation BSW refers to the boiler sidewall. There are 10 zones in this wall, labeled BSW1-BSW0. The abbreviation OSCR refers to the outlet screen. The abbreviation BBFW refers to the boiler front wall. The 4-character abbreviation BR in the boiler section refers to locations where multi-lead ribbed (MLR) tubes could be used. The 4-character abbreviation BS in the boiler section refers to locations where smooth tubes can be used. In the boiler section, the circuits that begin with BB1* through BB5* are fed by the clean section of the lower drum. The circuits that begin with BB6* through B11* are fed by the concentrated section of the lower drum.

In FIG. 6, the various circuits between the clean sections of the steam drum, intermediate drum, and lower drum are illustrated on the left-hand side.

The various circuits between the concentrated sections of the steam drum, intermediate drum, and lower drum are illustrated on the right-hand side. The clean sections and concentrated sections are connected only through the steam drum.

As indicated here, the clean section feeds the furnace sidewall FS, furnace rear wall FRW, the baffle wall BF, the boiler rear wall BRW, the rear portion of the boiler sidewall BSW1-BSW5, and the clean section steam generating banks BB1* through BB5*.

As indicated here, the concentrated section feeds the front portion of the boiler side wall BSW6-BSW0, the outlet screen OSCR, the concentrated section steam generating banks BB6* through B11*, and the boiler front wall BBFW.

The boilers of the present disclosure thus include three drums: a steam drum at the highest elevation of the boiler, an intermediate drum that is located below the steam drum and is connected to the steam through large riser connections, and a lower drum or mud drum. Downcomer pipes run from the steam drum to the lower drum and provide sub-cooled or near saturation temperature water to the lower drum. Tubes that form the D-wall furnace of the boiler and the convection pass enclosure of the boiler, originate from the lower drum and the tubes are configured to enter the intermediate drum. The tubes of the furnace and convection pass absorb the heat generated by the fuel (typically natural gas or fuel oil) that is burned on the front side of the boiler's furnace. The hot gases travel through the furnace turn 180 degrees and flow through the convection pass to the boiler outlet. If the boiler is equipped with an economizer, the remaining heat is absorbed in the economizer. The fluid from the economizer is used to replace the steam that is generated in the boiler.

It will be appreciated that the use of multi-circulation technology will significantly reduce the potential for formation of internal tube deposits and fouling of the tubes and other components through the use of sub-ASME boiler feedwater associated with the use of mechanical vapor compression water treatment commonly used to treat produced water for use as boiler feedwater in SAGD facilities. The "dirty" water has sub-ASME quality water conditions that require lower heat input so that the deposition of solids, salts, and organics are minimized within the tubes and drums of the boiler. Such "dirty" water runs through the concentrated sections of the boiler, and do not encounter the high heat fluxes that "clean" water is exposed to.

The boilers of the present disclosure can generate over 400,000 lbs/hour of steam under appropriate conditions. The components of these boilers can also be separated to meet height, width, and weight limits for easier shipping while reducing the amount of assembly that must be done on-site.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A boiler, comprising:

an intermediate drum comprising (A) a first internal divider within the intermediate drum that divides the intermediate drum into an intermediate drum clean section and an intermediate drum concentrated section, and (B) an intermediate drum channel that is fluidly connected to the intermediate drum clean section, the intermediate drum channel running adjacent a sidewall of the intermediate drum through the first internal divider to a distal end of the intermediate drum concentrated section;

a lower drum comprising (A) a second internal divider within the lower drum that divides the lower drum into a lower drum clean section and a lower drum concentrated section, and (B) a lower drum channel that is fluidly connected to the lower drum clean section, the lower drum channel running adjacent a sidewall of the lower drum through the second internal divider to a distal end of the lower drum concentrated section;

a furnace defined by a furnace sidewall and a baffle wall, wherein tubes in a front portion of the furnace sidewall and a front portion of the baffle wall extend between the intermediate drum channel and the lower drum channel;

a clean section steam generating bank extending between the intermediate drum clean section and the lower drum clean section; and a concentrated section steam generating bank extending between the intermediate drum concentrated section and the lower drum concentrated section.

2. The boiler of claim 1, wherein in a gas flowpath, the clean section steam generating bank is downstream of the furnace and upstream of the concentrated section steam generating bank.

3. The boiler according to claim 1 or 2, wherein the clean section steam generating bank and the concentrated section steam generating bank are located on an opposite side of the baffle wall from the furnace.

4. The boiler according to claim 1 or 2, wherein the concentrated section steam generating bank is located so that heat flux on the concentrated section steam generating bank is less than 20,000 BTU/hr-ft$^2$.

5. The boiler according to claim 1 or 2, wherein the furnace, the clean section steam generating bank, and the concentrated section steam generating bank operate by natural circulation, and do not contain mechanical pumps.

6. The boiler according to claim 1 or 2, wherein a ratio of a cross-sectional area of the intermediate drum channel to a cross-sectional area of the intermediate drum (inner diameter) is from about 0.1 to about 0.3.

7. The boiler according to claim 1 or 2, wherein a ratio of a cross-sectional area of the lower drum channel to a cross-sectional area of the lower drum (inner diameter) is from about 0.1 to about 0.3.

8. The boiler according to claim 1 or 2, further comprising:

a steam drum comprising a third internal divider within the steam drum that divides the steam drum into a steam drum clean section and a steam drum concentrated section, the third internal divider including a veer that fluidly connects the steam drum clean section and the steam drum concentrated section.

9. The boiler of claim 8, further comprising:

at least one clean section riser extending between the intermediate drum clean section and the steam drum clean section; and at least one concentrated section riser extending between the intermediate drum concentrated section and the steam drum concentrated section.

10. The boiler of claim 8, further comprising:

at least one clean section downcomer extending between the steam drum clean section and the lower drum clean section; and at least one concentrated section downcomer extending between the steam drum concentrated section and the lower drum concentrated section.

11. The boiler of claim 8, wherein the steam drum is located above the intermediate drum, and the intermediate drum is located above the lower drum.

12. The boiler of claim 8, wherein the steam drum comprises a scrubber and a perforated plate.

13. The boiler according to claim 1 or 2, further comprising a rear wall extending between the furnace sidewall and a boiler sidewall.

14. The boiler of claim 13, wherein multi-lead ribbed (MLR) tubing is used in the furnace sidewall, the rear wall, the boiler sidewall, the baffle wall, an area of the clean section steam generating bank, or an area of the concentrated section steam generating bank.

15. The boiler according to claim 1 or 2, further comprising an economizer downstream of the concentrated section steam generating bank in a gas flowpath.

16. The boiler of claim 15, further comprising an air preheater downstream of the economizer.

17. The boiler according to claim 1 or 2, further comprising burners located at a front end of the boiler, and adapted to provide a heated gas to the furnace.

18. The boiler of claim 17, further comprising a burner wall comprising tubes which run between the intermediate drum channel and the lower drum channel, the burner wall being located in front of the burners and including burner openings.

19. A method for using a boiler, comprising:

receiving a boiler that comprises an intermediate drum comprising (A) an intermediate drum divider within the intermediate drum that divides the intermediate drum into an intermediate drum clean section and an intermediate drum concentrated section, and (B) an intermediate drum channel that is fluidly connected to the intermediate drum clean section, the intermediate drum channel running adjacent a sidewall of the intermediate drum through the intermediate drum divider to a distal end of the intermediate drum concentrated section;

a lower drum comprising (A) a lower drum divider within the lower drum that divides the lower drum into a lower drum clean section and a lower drum concentrated section, and (B) a lower drum channel that is fluidly connected to the lower drum clean section, the lower drum channel running adjacent a sidewall of the lower drum through the lower drum divider to a distal end of the lower drum concentrated section;

a furnace defined by a furnace sidewall and a baffle wall, wherein tubes in a front portion of the furnace sidewall and a front portion of the baffle wall extend between the intermediate drum channel and the lower drum channel;

a clean section steam generating bank extending between the intermediate drum clean section and the lower drum clean section; and a concentrated section steam generating bank extending between the intermediate drum concentrated section and the lower drum concentrated section; and using steam generated by the boiler.

20. The method of claim 19, wherein the boiler further comprises:

a steam drum comprising a steam drum divider within the steam drum that divides the steam drum into a steam drum clean section and a steam drum concentrated section, the steam drum divider including a veer that fluidly connects the steam drum clean section and the steam drum concentrated section; and the method further comprises:

feeding water into to the steam drum clean section.

* * * * *